US005531487A

United States Patent [19]

Beresheim

[11] Patent Number: 5,531,487

[45] Date of Patent: Jul. 2, 1996

[54] LOCK ASSEMBLY HAVING A BOLT WITH AN EXTENDING TANG

[76] Inventor: Thomas H. Beresheim, 5816 S. Washtenaw, Chicago, Ill. 60629

[21] Appl. No.: 205,112

[22] Filed: Mar. 3, 1994

[51] Int. Cl.[6] ..... E05C 1/04

[52] U.S. Cl. ..... 292/146; 292/2

[58] Field of Search ..... 292/346, 146, 292/2, 254, 341.13; 70/416, 418, 419, 131, 142

[56] References Cited

U.S. PATENT DOCUMENTS

| | | | |
|---|---|---|---|
| 1,901,412 | 3/1933 | Richter | 292/2 X |
| 2,039,048 | 4/1936 | Agterberg | 292/2 X |
| 3,414,307 | 12/1968 | Russell | 292/2 |
| 3,948,550 | 4/1976 | Vigluicci et al. | 292/2 X |

FOREIGN PATENT DOCUMENTS

| | | | |
|---|---|---|---|
| 232 | 9/1899 | Australia | 292/2 |
| 2307106 | 11/1976 | France | 292/346 |
| 375270 | 5/1923 | Germany | 292/2 |

*Primary Examiner*—Peter M. Cuomo
*Assistant Examiner*—Jerry Redman
*Attorney, Agent, or Firm*—Emrich & Dithmar

[57] ABSTRACT

A lock includes a first housing attached to a door and having an extendible latch bolt and further includes a second housing, or striker, attached to an adjacent doorjamb and including an inner slot for receiving the latch bolt. The latch bolt includes a generally flat inner surface and a convex outer, leading surface in facing relation to the adjacent doorjamb. Disposed on a distal end portion of the latch bolt's inner flat surface is a first projection, or tang, while disposed on an outer edge of the striker's inner slot is a second projection, or lip. With a given amount of "play", or free movement, of the door relative to the doorjamb, the door may be opened by urging the door outward and actuating a release knob in the first body for withdrawing the latch bolt from the striker and into the first housing, with clearance provided between the latch bolt's tang and the striker's inner lip. When an attempt is made to release the lock from outside by engaging the latch bolt's convex outer leading surface with a thin, flat, semi-rigid element such as a plastic card, or metal blade, in urging the latch bolt to the retracted position within the first housing, the "play" in the door allows for inward displacement of the latch bolt causing the latch bolt's outer tang to engage the striker's inner lip. This prevents retraction of the latch bolt and opening of the lock.

9 Claims, 1 Drawing Sheet

LOCK ASSEMBLY HAVING A BOLT WITH AN EXTENDING TANG

FIELD OF THE INVENTION

This invention relates generally to locks such as for locking a door and is particularly directed to a lock having an extendable latch bolt which is secure against opening from the outside.

BACKGROUND OF THE INVENTION

Door locks take on various forms. In general, a door lock includes a first housing mounted to an inner surface of or disposed within the door and including a sliding bolt. The lock further includes a second housing, commonly known as a striker, attached to or disposed within an adjacent doorjamb which includes a slot for receiving the bolt when extended from the first housing with the door in the closed position. The bolt may be moved to the retracted position allowing for the opening of the door either by means of a key inserted in the lock from outside or by means of a rotatable knob located on the inside of the lock.

Security is, of course, highly desirable in lock design. The ability to break or bypass the lock permitting opening of the door from the outside renders the lock essentially useless. Many bolt-type locks have a bolt with a curvilinear, or convex, surface facing outwardly from the room into which the door is pivotally displaced when opened. The convex outer, or leading, surface of the bolt allows the bolt to engage and ride over the striker mounted to the doorjamb, followed by extension of the bolt from the lock housing for positioning within an inner recess or slot of the striker for locking the door after it is closed. While the convex, leading surface of the bolt allows for automatic locking of the door upon closure, it renders the lock susceptible to opening from outside. For example, a thin, flat object such as a plastic credit card or the blade of a metal screwdriver inserted in a gap between the door and doorjamb so as to engage the convex bolt surface may be used to urge the bolt to the retracted position, allowing the door to be opened. This is a common method for gaining unauthorized and frequently illegal entry into a secure space. This method of entry may be accomplished repeatedly without the owner or occupier of the premises even being aware of it. This unauthorized method of entry is quick, does not require the use of expensive tools or special training, and is relatively quiet.

The present invention addresses the aforementioned limitations of the prior art by providing a lock having a latch bolt with a convex outer, or leading, surface which cannot be released by the insertion of a thin, flat, object between the door and adjacent doorjamb and thus prevents unauthorized entry.

OBJECTS AND SUMMARY OF THE INVENTION

Accordingly, it is an object of the present invention to provide a more secure lock such as for securing a door.

Another object of the present invention is to prevent retraction of a latch bolt such as in a door lock and opening of the door from outside.

Yet another object of the present invention is to prevent unlocking a lock by inserting a thin, flat member such as a plastic card or metal blade between the door and adjacent doorjamb from outside of the door and urging the lock's bolt to the retracted position.

These and other objects of the present invention are achieved by a lock comprising a housing mounted within or to an inside surface of a door, the housing including a first inner slot; a striker mounted to a doorjamb disposed in close proximity to the door, wherein the striker is disposed adjacent the housing when the door is in a closed position, the striker including a second inner slot and an inwardly projecting lip disposed adjacent an outer edge of the second inner slot, wherein the second inner slot is disposed adjacent to and in alignment with the first slot when the door is in the closed position; a bolt disposed in the first inner slot of the housing and movable between a retracted position and an extended position for insertion in the second inner slot of the striker for maintaining the door locked in the closed position, the bolt including a generally flat inner surface and a convex distal outer surface; and a latch member disposed on the generally flat inner surface of the bolt for engaging the inwardly projecting lip in the second inner slot of the striker when the convex outer surface of the bolt is engaged by an object and the bolt is urged toward the inwardly projecting lip.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENT

Figure 1:
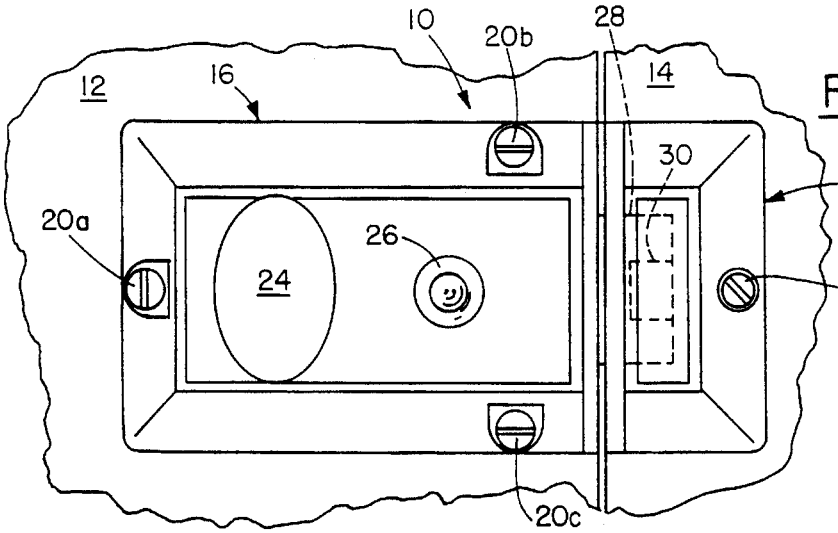
FIG. 1 is a plan view shown partially in phantom of a lock in accordance with the present invention.
Figure 2:
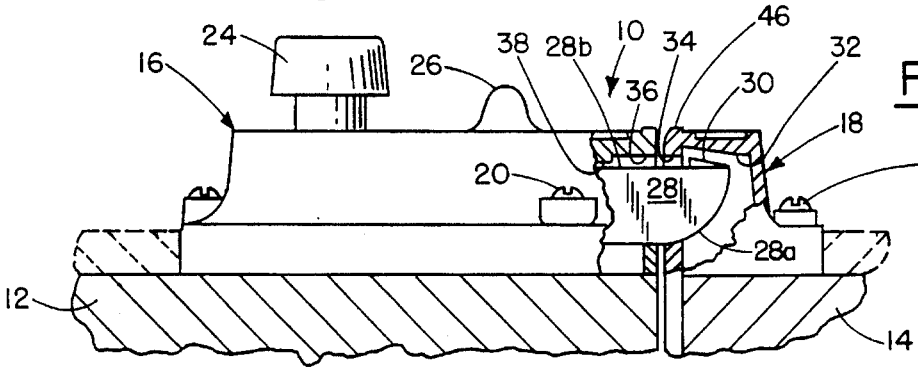
FIG. 2 is a side elevation view of the lock of FIG. 1 shown partially cut away illustrating the lock in the locked configuration.
Figure 3:
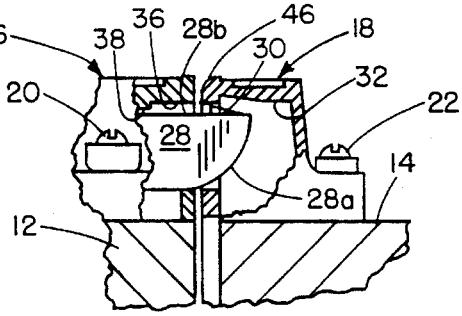
FIG. 3 is a partial side elevation view shown partially cut away of the lock of FIG. 2 illustrating the lock with its latch bolt partially retracted.
Figure 4:
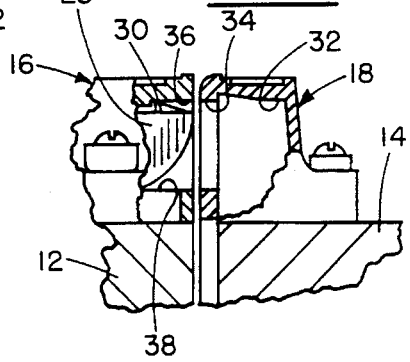
FIG. 4 is a partial side elevation view shown partially cut away of the lock shown in FIG. 2 illustrating the lock in the unlocked configuration with its latch bolt fully retracted.

Referring to FIG. 1, there is a plan view shown partially in phantom of a lock 10 in accordance with the principles of the present invention. FIG. 2 is a side elevation view shown partially cutaway of the lock of FIG. 1. FIGS. 3 and 4 are partial side elevation views shown partially cut away of lock 10 in the partially retracted and fully retracted, or unlocked, positions, respectfully. Lock 10 includes a first housing, or body, 16 and a second housing, or striker, 18. Housing 16 is securely attached to the inner surface of a door 12 by conventional means such as a plurality of spaced threaded mounting pins, or screws, 20*a*, 20*b*, and 20*c*. While housing 16 is shown attached to an inner surface of door 12, the present invention is not limited to this mounting arrangement, but encompasses virtually any mounting arrangement of the housing to the door such as attaching the housing to a recessed portion of the door as shown in dotted line form in FIG. 2 or incorporating the lock within the door as in the case of a mortise lock. Similarly, striker 18 is securely mounted to an inner surface of or to a recessed portion in a doorjamb 14 disposed adjacent door 12 by means of a threaded mounting pin 22. Housing 16 and striker 18 are each typically comprised of a rigid, high strength metal and are disposed within the room to which door 12 provides access.

Disposed within striker 18 is a first inner slot, or recessed portion, 32. Disposed along the length of and extending into the first inner slot 32 is an inner lip 34 extending from striker 18. Similarly, disposed within housing 16 is an elongated, linear, second inner slot 38 having a groove, or relieved portion 36 in an end thereof. The second inner slot 38 extends into and along at least of the portion of the length of the housing 16.

Disposed within the second inner slot 38 and movable therein in a sliding manner is a latch bolt 28. Latch bolt 28 is movable between an extended position as shown in FIGS. 1 and 2 and a fully retracted position as shown in FIG. 4 and as described below. Attached to housing 16 is a position knob 24 for moving latch bolt 28 between the retracted and extended positions. Suitable mechanical linkage well known to those skilled in the relevant art couples position knob 24 and latch bolt 28. This linkage may be conventional in design and operation and does not form a part of the present invention. This linkage is thus not shown in the figures and is not further discussed herein. Latch bolt 28 is typically urged to the extended position as shown in FIGS. 1 and 2 by means of a resilient member such as a spring (also not shown in the figures for simplicity), and is retracted by means of the position knob 24 and the aforementioned coupling linkage. Also attached to housing 16 and coupled to the latch bolt 28 is a movable locking knob 26. With locking 26 in a first position, latch bolt 28 may be retracted as shown in FIG. 4 by means of position knob 24. With locking knob 26 in a second position, latch bolt 28 is prevented from being retracted into housing 16 by means of position knob 24. The operation and coupling of the position knob 24 and locking knob 26 with the latch bolt 28 may be conventional in design and operation and is not further discussed herein.

Latch bolt 28 includes a leading surface **28*a* and an inner surface 28*b*. Inner surface 28*b* is generally flat, or planar, and is oriented towards the room or space to which door 12 provides access. The latch bolt's leading surface 28*a* is curvilinear, having a convex contour. Door 12 is opened by pivotally displacing the door in an inward direction as shown by arrow 42 in FIG. 5 to provide access to space generally illustrated above the door and doorjamb 14 in this figure. The curvilinear leading surface 28*b* of latch bolt 28 contacts a curvilinear edge 46 of striker 18 as the door is moved to the closed position. When the latch bolt 28 engages striker 18 during door closure, the curvilinear leading surface 28*a* of the latch bolt causes the latch bolt to be urged inwardly into housing 16. Striker 18 thus displaces the latch bolt 28 to the retracted position, permitting full closure of the door 12. Following alignment of the first housing 16 with striker 18 with the door 12 in the fully closed position, latch bolt 28 is urged outward from the housing by a suitable biasing means such as a spring (not shown for simplicity) and into the first inner slot 32** of the striker.

Figure 5:
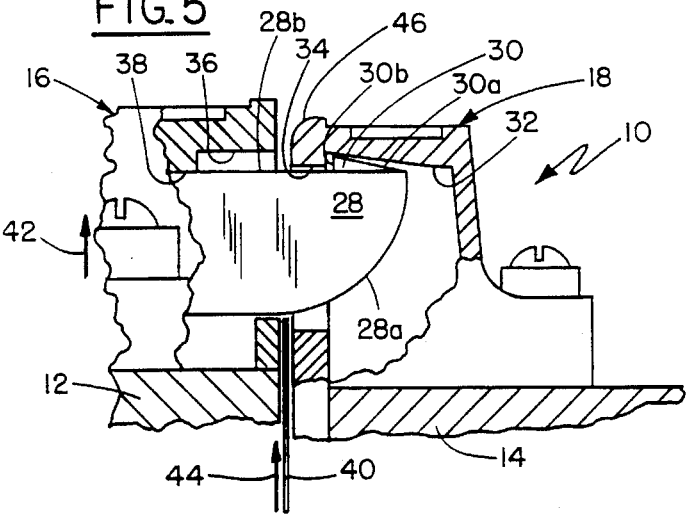
FIG. 5 is a partial side elevation view shown partially cut away of the lock of FIG. 1 illustrating the lock in the secure locked configuration during an attempt to open the lock from outside.
Figure 6:
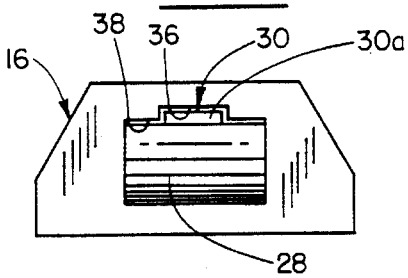
FIG. 6 is an end-end view of the housing and latch bolt of the lock of the present invention.

With reference particularly to FIGS. 5 and 6, operation of the lock 10 of the present invention in preventing unlocking of the lock from the outside will now be described.

FIG. 5 is partial side elevation view of the inventive lock 10 shown partially cut away, while FIG. 6 is a front plan view of the lock's housing 16. Disposed on the flat inner edge **28*b* of latch bolt 28 is a projecting rib, or tang, 30. Tang 30 has a generally triangular cross section and extends along a substantial portion of the width of latch bolt 28 as shown in FIG. 6. Tang 30 may be formed integrally with latch bolt 28 or may be a separate element securely attached to the latch bolt by conventional means such as a weldment. With latch bolt 28 extended from housing 16 and inserted in the striker's first inner slot 32, insertion of a thin, semi-rigid member 40 in the direction of arrow 44 in FIG. 5 between door 12 and doorjamb 14*b* so as to engage the curvilinear leading surface 28*a* of latch bolt 28 causes the inward displacement of the latch bolt and door as viewed in FIG.5. This inward displacement arises from the "play", or free movement, inherent in virtually every door installation. When latch bolt 28 is displaced upward in the direction of arrow 44 as shown in FIG. 5, the latch bolt's tang 30 is moved in alignment with the striker's inner lip 34 for preventing withdrawal of the latch bolt from the striker 18. In this manner, undoing of lock 10 from outside of the room in which the lock is disposed by insertion of a thin, semi-rigid member 40 into the gap between the door 12 and doorjamb 14 is prevented. The thin, semi-rigid member 40 may be in the form of a plastic credit card or the metal blade of a screwdriver. The "play" in the door 12 relative to doorjamb 14 is shown by the misalignment of these two structures in FIG. 5 caused by engagement of the latch bolt 28 by the thin, semi-rigid member 40. The lock may be manually unlocked from inside by moving the door 12 outwardly or opposite to the direction of arrow 42 to allow the latch bolt's tang 30 to clear the striker's inner lip 34. Latch bolt 28 may then be withdrawn from striker 18 and retracted into the lock's housing 16 by means of the position knob 24 as described above. Tang 30 includes a beveled leading surface 30 a to facilitate insertion of latch bolt 28 into the striker's inner slot 32. Tang 30 further includes an angled trailing surface 30*b* to provide secure engagement with the striker's inner lip 34 for preventing removal of the latch bolt 28 from striker 18**.

There has thus been shown a lock having a latch bolt which cannot be unlocked from outside by inserting a thin, semi-rigid member such as a plastic credit card or screwdriver blade into the gap between a door and adjacent doorjamb. The latch bolt is slidingly positioned within a housing mounted to an inner surface of the door. With the door closed, the latch bolt extends from the housing into a striker mounted to the doorjamb. An inner, flat surface of the latch bolt includes a tang extending therefrom which engages an inner lip of the striker when the latch bolt is moved inwardly such as when engaged by a thin, flat object inserted from outside into the gap between the door and doorjamb. Engagement of the latch bolt's tang with the striker's inner lip prevents retraction of the latch bolt into the lock's housing and maintains the lock in a secured configuration. While the present invention has been described in terms of a lock mounted to the inner surfaces of a door and doorjamb, this invention also contemplates mounting the lock within the door and adjacent doorjamb as in the case of a mortise lock.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A lock comprising:

a housing mounted to an inner surface of a door, said housing including a first inner slot;

a striker mounted to an inner surface of a doorjamb disposed in close proximity to said door, wherein said striker is disposed adjacent said housing when said door is in a closed position, said striker including a second inner slot and an inwardly projecting lip disposed adjacent an outer edge of said second inner slot, wherein said second inner slot is disposed adjacent to and in alignment with said first slot when said door is in said closed position;

bolt means disposed in said first inner slot of said housing and movable between a retracted position and an extended position for insertion in the second inner slot of said striker for maintaining the door locked in said closed position, said bolt means including a generally flat inner surface and convex distal outer surface; and latch means including a tang extending outwardly from the generally flat inner surface of said bolt means which engages the inwardly projecting lip in the second inner slot of said striker when the convex outer surface of said bolt means is engaged by an object and said bolt means is urged toward said inwardly projecting lip.

2. The lock of claim 1 wherein the inwardly projecting lip of said striker extends substantially along the entire width of said second inner slot in said striker and is disposed adjacent an outer surface of said striker in facing relation to said housing.

3. The lock of claim 2 wherein said inner lip is distally disposed in said striker relative to said doorjamb.

4. The lock of claim 1 wherein said tang includes a beveled leading surface to facilitate insertion of said bolt means into the inner slot of said striker.

5. The lock of claim 4 wherein said tang further includes a trailing surface forming a sharp edge with said beveled leading surface for more secure engagement of said tang with the inwardly projecting lip of said striker.

6. The lock of claim 1 wherein said tang is formed integrally with said bolt means.

7. The lock of claim 1 wherein said tang is attached to the inner surface of said bolt means by a weldment.

8. The lock of claim 1 wherein the inner slot of said housing includes a notch in an outer end thereof for receiving said tang once said bolt means is retracted into said housing.

9. The lock of claim 1 wherein said striker includes a curvilinear edge for engaging the convex distal surface of said bolt means when the door is closed to facilitate retraction of said bolt means into said housing during door closure.

* * * * *